US010384897B2

(12) United States Patent
Takano et al.

(10) Patent No.: US 10,384,897 B2
(45) Date of Patent: Aug. 20, 2019

(54) SHEET-MEMBER SEPARATION DEVICE, SHEET-MEMBER SEPARATION METHOD, PROGRAM, AND IMAGE FORMING APPARATUS

(71) Applicants: Satoru Takano, Kanagawa (JP); Hidehiko Fujiwara, Tokyo (JP); Takeshi Akai, Kanagawa (JP); Yasuo Niikura, Kanagawa (JP); Yousuke Edo, Kanagawa (JP); Yasunori Hino, Kanagawa (JP); Tadashi Matsuoka, Kanagawa (JP); Atsunori Yoshida, Kanagawa (JP); Ryo Kanno, Kanagawa (JP); Hikaru Fukasawa, Kanagawa (JP)

(72) Inventors: Satoru Takano, Kanagawa (JP); Hidehiko Fujiwara, Tokyo (JP); Takeshi Akai, Kanagawa (JP); Yasuo Niikura, Kanagawa (JP); Yousuke Edo, Kanagawa (JP); Yasunori Hino, Kanagawa (JP); Tadashi Matsuoka, Kanagawa (JP); Atsunori Yoshida, Kanagawa (JP); Ryo Kanno, Kanagawa (JP); Hikaru Fukasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/377,312

(22) Filed: Dec. 13, 2016

(65) Prior Publication Data

US 2017/0174458 A1 Jun. 22, 2017

(30) Foreign Application Priority Data

Dec. 16, 2015 (JP) ..... 2015-245680
Feb. 24, 2016 (JP) ..... 2016-033609

(51) Int. Cl.
*B65H 3/48* (2006.01)
*B65H 3/12* (2006.01)
(Continued)

(52) U.S. Cl.
CPC ..... *B65H 9/20* (2013.01); *B65H 3/128* (2013.01); *B65H 3/48* (2013.01); *B65H 7/14* (2013.01);
(Continued)

(58) Field of Classification Search
CPC . B65H 3/48; B65H 3/128; B65H 3/14; B65H 2406/364; B65H 2406/323; B65H 7/14; B65H 7/16
See application file for complete search history.

(56) References Cited

U.S. PATENT DOCUMENTS 5,110,110 A * 5/1992 Wirz ..... B65H 3/48 239/587.1
5,480,136 A * 1/1996 Meyer ..... B65H 29/32 271/176
(Continued)

FOREIGN PATENT DOCUMENTS

CN 1041924 A 5/1990
CN 101266428 A 9/2008
(Continued)

OTHER PUBLICATIONS

U.S. Appl. No. 15/163,850, filed May 25, 2016.
(Continued)

*Primary Examiner* — Luis A Gonzalez
(74) *Attorney, Agent, or Firm* — Oblon, McClelland, Maier & Neustadt, L.L.P.

(57) ABSTRACT

A sheet-member separation device includes a first air blower, an attractor, a conveyor, a second air blower, and an adjuster. The first air blower blows air onto a front side of a
(Continued)

stack of sheet members in a sheet-member conveyance direction. The attractor attracts an uppermost sheet member floated from the stack of sheet members by the air blown from the first air blower. The conveyor conveys, in the sheet-member conveyance direction, the sheet member attracted by the attractor. The second air blower blows air toward a lateral side of the sheet member. The adjuster moves the second air blower and the attractor together to adjust positions of the second air blower and the attractor in the sheet-member conveyance direction.

18 Claims, 14 Drawing Sheets

(51) Int. Cl.
*B65H 9/20* (2006.01)
*G03G 15/00* (2006.01)
*B65H 7/14* (2006.01)

(52) U.S. Cl.
CPC ..... *G03G 15/6511* (2013.01); *G03G 15/6532* (2013.01); *B65H 2403/52* (2013.01); *B65H 2406/323* (2013.01); *B65H 2511/17* (2013.01); *B65H 2511/20* (2013.01); *G03G 2215/004* (2013.01); *G03G 2215/00396* (2013.01)

(56) References Cited

U.S. PATENT DOCUMENTS

| | | | | |
|---|---|---|---|---|
| 7,654,514 | B2 * | 2/2010 | Milillo | B65H 3/0816 271/105 |
| 8,074,978 | B2 * | 12/2011 | Takahashi | B65H 3/128 271/97 |
| 9,284,139 | B2 * | 3/2016 | Otsuka | B65H 3/0833 |
| 2008/0012202 | A1 * | 1/2008 | Hubl | B65H 3/10 271/98 |
| 2008/0012208 | A1 | 1/2008 | Fujiwara et al. | |
| 2009/0127767 | A1 | 5/2009 | Milillo | |
| 2009/0257846 | A1 | 10/2009 | Matsushita et al. | |
| 2010/0225053 | A1 | 9/2010 | Nakamura et al. | |
| 2012/0002252 | A1 | 1/2012 | Kubo et al. | |
| 2012/0153556 | A1 | 6/2012 | Sugiyama et al. | |
| 2012/0267846 | A1 | 10/2012 | Nakada et al. | |
| 2012/0282004 | A1 | 11/2012 | Furuhashi et al. | |
| 2013/0113154 | A1 | 5/2013 | Furuhashi et al. | |
| 2013/0134659 | A1 | 5/2013 | Konno et al. | |
| 2013/0147105 | A1 | 6/2013 | Sugiyama et al. | |
| 2013/0175755 | A1 | 7/2013 | Machida et al. | |
| 2013/0215481 | A1 | 8/2013 | Hayasaka et al. | |
| 2013/0228965 | A1 | 9/2013 | Hoshino et al. | |
| 2013/0236228 | A1 | 9/2013 | Nagasako et al. | |
| 2013/0242359 | A1 | 9/2013 | Heishi et al. | |
| 2013/0320611 | A1 | 12/2013 | Kubo et al. | |
| 2014/0011656 | A1 | 1/2014 | Niikura et al. | |
| 2014/0131938 | A1 | 5/2014 | Satoh et al. | |
| 2014/0140744 | A1 | 5/2014 | Akai et al. | |
| 2014/0145395 | A1 | 5/2014 | Takano et al. | |
| 2014/0159301 | A1 | 6/2014 | Suzuki et al. | |
| 2014/0203501 | A1 | 7/2014 | Hoshino et al. | |
| 2014/0239573 | A1 | 8/2014 | Akai et al. | |
| 2015/0045197 | A1 | 2/2015 | Sugiyama et al. | |
| 2015/0065326 | A1 | 3/2015 | Musha et al. | |
| 2015/0091246 | A1 | 4/2015 | Yoshida et al. | |
| 2015/0093214 | A1 | 4/2015 | Takahashi et al. | |
| 2015/0166280 | A1 | 6/2015 | Hino et al. | |
| 2015/0225191 | A1 | 8/2015 | Niikura et al. | |
| 2015/0253716 | A1 | 9/2015 | Nagasako et al. | |
| 2015/0360899 | A1 | 12/2015 | Takahashi et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0170355 | A1 | 6/2016 | Heishi et al. | |
| 2016/0185552 | A1 | 6/2016 | Hoshino et al. | |
| 2016/0221787 | A1 | 8/2016 | Matsushita et al. | |
| 2016/0264370 | A1 | 9/2016 | Okutsu et al. | |
| 2016/0340144 | A1 | 11/2016 | Sakano et al. | |
| 2016/0340145 | A1 | 11/2016 | Kunieda et al. | |

FOREIGN PATENT DOCUMENTS

| | | | | |
|---|---|---|---|---|
| CN | 101585454 | A | 11/2009 | |
| CN | 101910031 | A | 12/2010 | |
| CN | 101927912 | A | 12/2010 | |
| CN | 104080718 | A | 10/2014 | |
| DE | 3622693 | A1 * | 1/1988 | B65H 3/0825 |
| DE | 10307135 | A1 * | 10/2003 | B65H 3/0816 |
| JP | 59149250 | A * | 8/1984 | B65H 3/48 |
| JP | 60096345 | U * | 7/1985 | |
| JP | 63247234 | A * | 10/1988 | |
| JP | 07053072 | A * | 2/1995 | B65H 3/0816 |
| JP | 2002-328716 | | 11/2002 | |
| JP | 2006-001682 | | 1/2006 | |
| JP | 2013091550 | A * | 5/2013 | |
| JP | 2013-234049 | | 11/2013 | |
| JP | 2014-152023 | | 8/2014 | |
| JP | 2015-120602 | | 7/2015 | |

OTHER PUBLICATIONS

U.S. Appl. No. 15/258,342, filed Sep. 7, 2016.
U.S. Appl. No. 15/276,894, filed Sep. 27, 2016.
Chinese Office Action issued in Chinese Patent Application No. 201611152086.5 dated Jan. 26, 2018, citing documents AA and AO-AT therein.

* cited by examiner

SHEET-MEMBER SEPARATION DEVICE, SHEET-MEMBER SEPARATION METHOD, PROGRAM, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2015-245680, filed on Dec. 16, 2015, and 2016-033609, filed on Feb. 24, 2016, in the Japan Patent Office, the entire disclosure of which is hereby incorporated by reference herein.

BACKGROUND

Technical Field

Aspects of the present disclosure relate to a sheet-member separation device, a sheet-member separation method, a program, and an image forming apparatus.

Related Art

Devices and methods for separating and conveying sheets are known.

SUMMARY

In one aspect of the present disclosure, there is provided a sheet-member separation device that includes a first air blower, an attractor, a conveyor, a second air blower, and an adjuster. The first air blower blows air onto a front side of a stack of sheet members in a sheet-member conveyance direction. The attractor attracts an uppermost sheet member floated from the stack of sheet members by the air blown from the first air blower. The conveyor conveys, in the sheet-member conveyance direction, the sheet member attracted by the attractor. The second air blower blows air toward a lateral side of the sheet member. The adjuster moves the second air blower and the attractor together to adjust positions of the second air blower and the attractor in the sheet-member conveyance direction.

In another aspect of the present disclosure, there is provided an image forming apparatus that includes the sheet-member separation device.

In yet another aspect of the present disclosure, there is provided a sheet-member separation method includes blowing air, by a first air blower, onto a front of a stack of sheet members in a sheet-member conveyance direction; attracting, by an attractor, an uppermost sheet member floated from the stack of sheet members by the air blowing from the first air blower; separating the floated uppermost sheet member from a sheet member immediately below the uppermost sheet member of the stack of sheet members; sucking and conveying the floated uppermost sheet member; and moving the attractor and a second air blower to blow air toward a side of the sheet member, together along the sheet-member conveyance direction.

In still yet another aspect of the present disclosure, there is provided a non-transitory computer readable storage medium that stores a computer readable program to cause a computer of a sheet-member separation device to execute processes. The processes includes causing a first air blower to blow air onto a front of a stack of sheet members in a sheet-member conveyance direction; causing an attractor to attract a uppermost sheet member floated from the stack of sheet members by the air blown from the first air blower; causing a conveyor to convey, in the sheet-member conveyance direction, the uppermost sheet member attracted by the attractor; causing a second air blower to blow air toward a lateral side of the uppermost sheet member; and causing an adjuster to move the second air blower and the attractor together to adjust positions of the second air blower and the attractor in the sheet-member conveyance direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
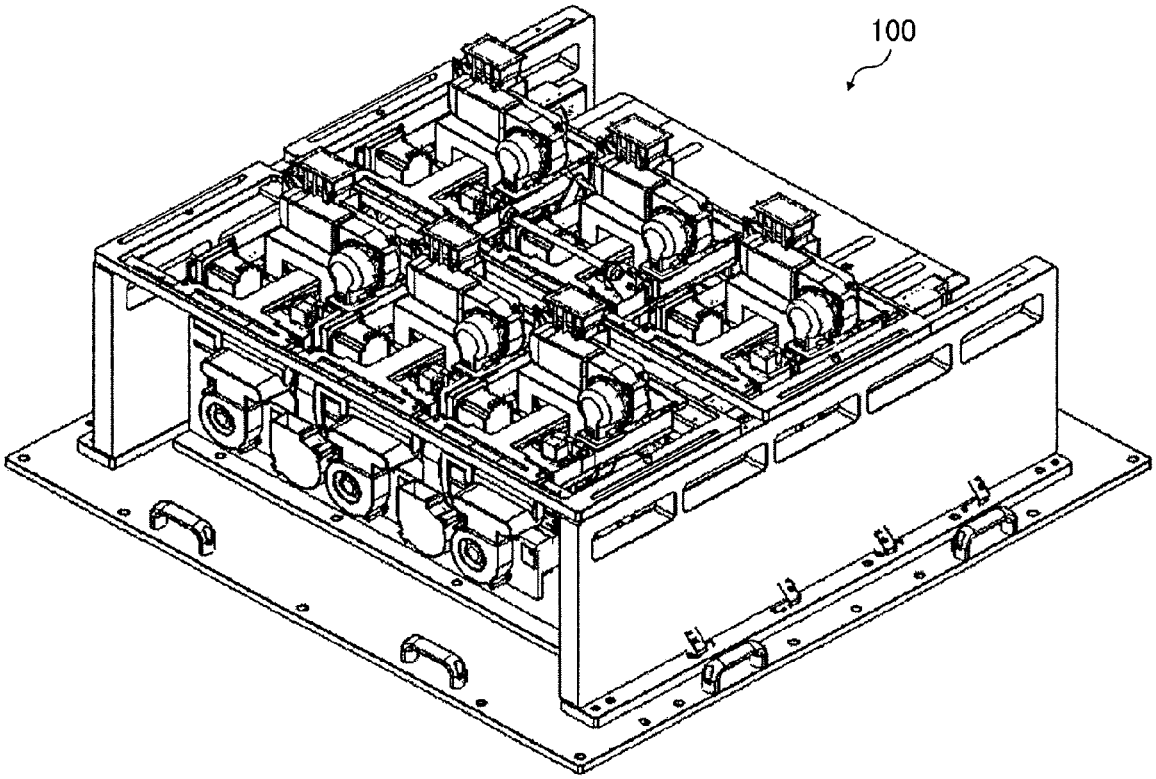
FIG. 1 is an outer perspective view of a general configuration of a prepreg-sheet separation device as a sheet-member separation device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

First Embodiment: Prepreg-Sheet Separation Device

Mechanical Configuration

FIG. 1 is an outer perspective view of a general configuration of a prepreg-sheet separation device as a sheet-member separation device according to an embodiment of the present disclosure. Below, a description is given of a case in which a prepreg sheet is used as a sheet member. In the present embodiment, the prepreg sheet has the size of, for example, 700 mm×500 mm. However, the size of the prepreg sheet is not limited to the above-described size. In the following description, common reference codes are allocated to the same or similar members. In a prepreg-sheet separation device 100 according to the present embodiment, a plurality of attraction air units 1 as attractors is disposed. (In FIG. 1, a total of six attraction air units are arrayed in a matrix with three rows and two columns. However, the number of the attraction air units is not limited to 6.) On the discharge side of the prepreg-sheet separation device 100, three separators, that is, separation floating air units 3 as a first air blower are disposed.

Figure 2:
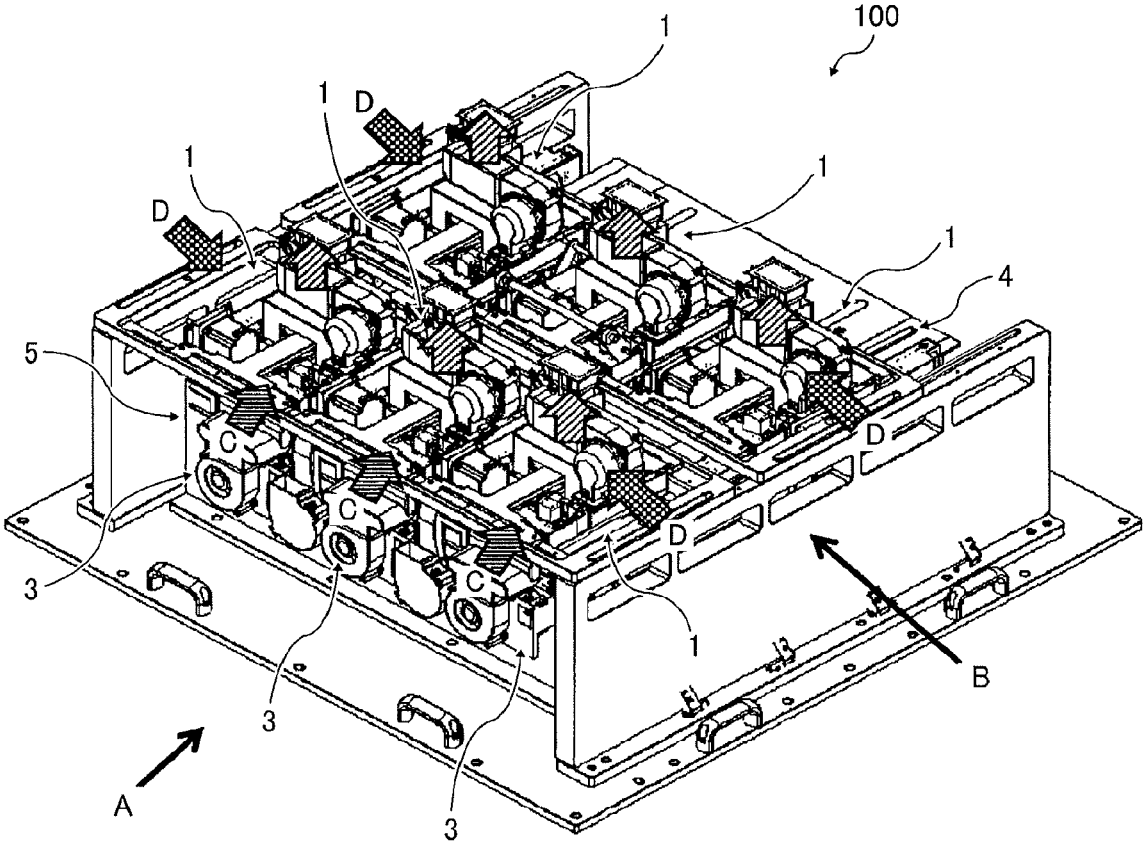
FIG. 2 is an illustration of the prepreg-sheet separation device illustrated in FIG. 1 and flows of air.

FIG. 2 is an illustration of the prepreg-sheet separation device illustrated in FIG. 1 and flows of air.

In FIG. 2, the prepreg-sheet separation device 100 includes the attraction air units 1 as the attractors, the separation floating air units 3 as the separators, and a bottom plate 4. Arrow A denotes a direction viewed from a discharge port, and arrow B denotes a direction viewed from the front side. Three arrows C oriented in a direction indicated by arrow A indicate the direction of air blown out from the separation floating air units 3. Four arrows D that are oriented in a direction indicated by arrow B and the opposite direction indicate the direction of distribution air. Up-pointing bold arrows indicate the suction direction of the attraction air units 1.

Figure 3:
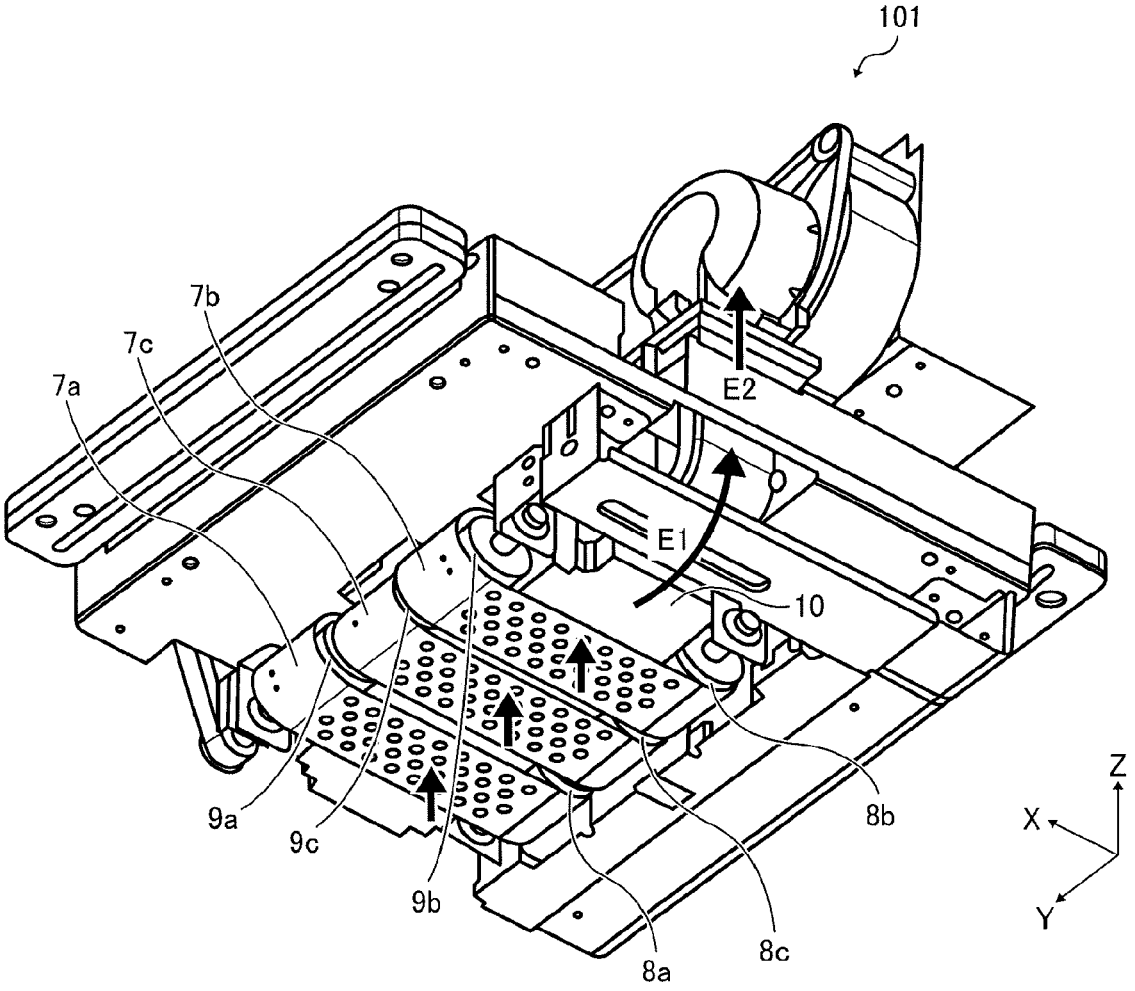
FIG. 3 is an illustration of an attraction unit extracted from FIG. 2.

FIG. 3 is an illustration of an attraction unit 101 extracted from FIG. 2. The attraction unit 101 includes attraction belts 7*a*, 7*b*, and 7*c*, driven pulleys 8*a*, 8*b*, and 8*c*, drive pulleys 9*a*, 9*b*, and 9*c*, and an attraction chamber 10. Three up-pointing bold arrows in FIG. 3 indicate the flow of air sucked into the attraction chamber 10, and the air is ejected in a direction indicated by arrows E1 and E2.

Figure 4:
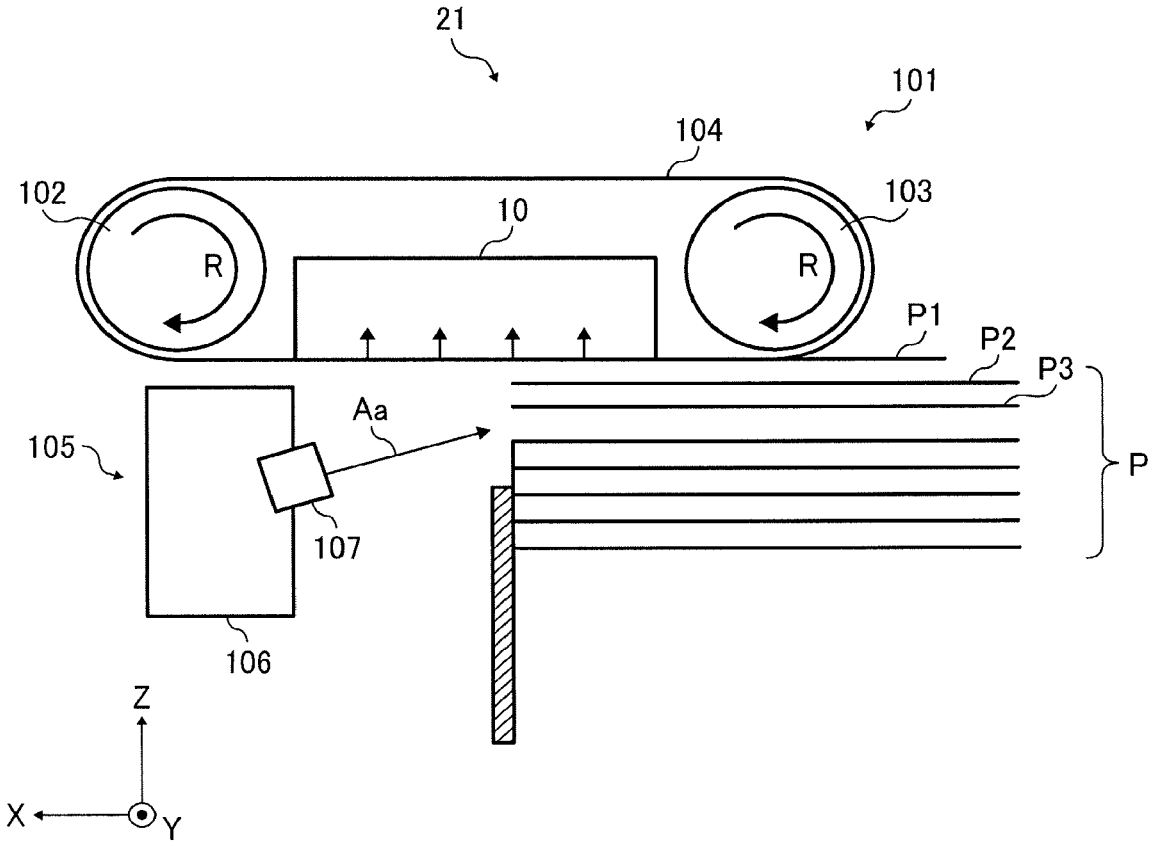
FIG. 4 is a schematic diagram of a separation method of a prepreg sheet in the prepreg-sheet separation device according to an embodiment of the present disclosure.

FIG. 4 is a schematic diagram of a separation method of a prepreg sheet in the prepreg-sheet separation device. As illustrated in FIG. 4, the attraction unit 101 includes a drive roller 102, a driven roller 103, a conveyance belt 104, and the attraction chamber 10.

The drive roller 102 is driven by, e.g., a drive motor to rotate in a direction indicated by arrow R, and the driven roller 103 similarly rotates in the direction indicated by arrow R, with rotation of the conveyance belt 104 rotated by the rotational driving of the drive roller 102.

The conveyance belt 104 conveys a prepreg sheet P, and is an endless belt member including a number of suction holes communicated with the attraction chamber 10.

The attraction chamber 10 keeps a negative pressure state by being sucked from the outside, and sucks an uppermost prepreg sheet P1 stacked on a platform truck, through the suction holes of the conveyance belt 104. The conveyance belt 104 holds the floated prepreg sheet P1 by sucking the prepreg sheet P1, and conveys the held prepreg sheet P1 toward a conveyance device.

An air ejection nozzle unit 105 to blow air (air being pressurized gas) onto the prepreg sheets P is disposed at a position opposing a front end of the prepreg sheets P stacked on a lower part of a device body 21 of the prepreg-sheet separation device 100. The front end of the prepreg sheets P refers to an end in a case in which a conveyance direction of the prepreg sheet P indicated by arrow F in FIG. 5 is assumed to be a forward direction.

In the air ejection nozzle unit 105, an air chamber 106 to store air sent from the outside is disposed. The air chamber 106 has an ejection nozzle 107 as an ejection port to blow (eject) air.

The ejection nozzle 107 ejects and blows air toward the front end of the prepreg sheet P in a direction indicated by arrow Aa, to float the uppermost prepreg sheet P1 from a bundle of the prepreg sheets P (prepreg sheets P1, P2, P3, and so on). Note that the air ejection nozzle unit 105 is an example of a float separator that separates the prepreg sheets P stacked on the device body 21 of the prepreg-sheet separation device, by ejecting air onto the prepreg sheets P and floating the prepreg sheet P.

Figure 5:
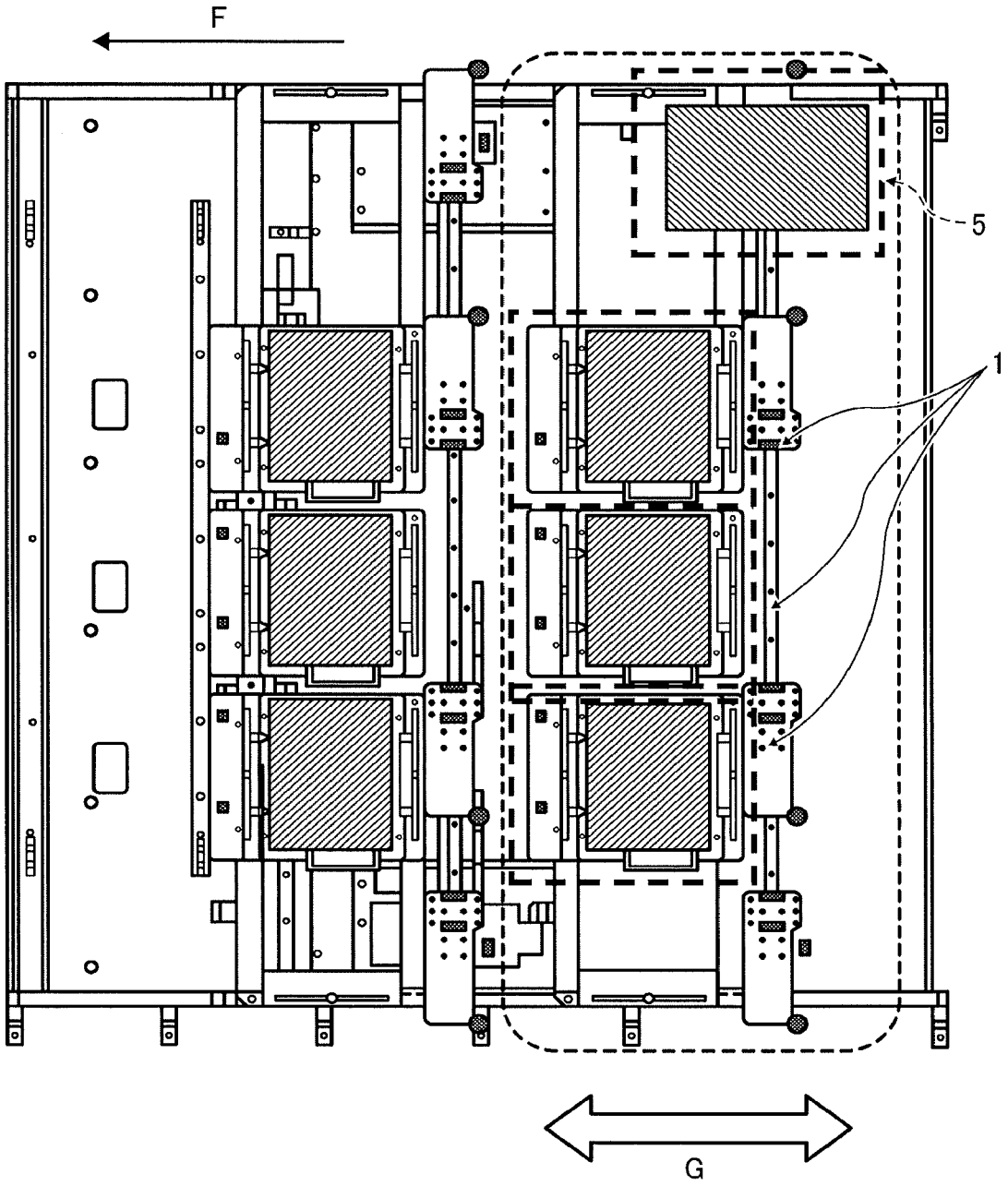
FIG. 5 is a top view of the prepreg-sheet separation device.

FIG. 5 is a top view of the prepreg-sheet separation device 100. The attraction air units 1 and the distribution floating air unit 5 disposed on a sheet lateral side restrictor are integrally formed as a single unit to be reciprocally movable relative to the conveyance direction F of the prepreg sheet as indicated by arrow G in FIG. 5. Alternatively, if the attraction air units 1 and the distribution floating air unit 5 are separately formed, the attraction air units 1 and the distribution floating air unit 5 are formed to be reciprocally movable relative to the conveyance direction F in conjunction with each other. The attraction air units 1 and the distribution floating air unit 5 are formed to be movable to an optimum position according to the length of the prepreg sheet or the rigidity of the prepreg sheet. Here, the distribution floating air unit 5 as a second air blower blows out air toward the side of the prepreg sheet. In other words, the distribution floating air unit 5 ejects air in a direction intersecting with the conveyance direction F of the prepreg sheet (it is sufficient that the conveyance direction F and the air blowing direction of the distribution floating air unit 5 form an angle). Ejecting air from the distribution floating air unit 5 assists the separation by decreasing the adhesion between the prepreg sheets. Here, the lateral sides of the prepreg sheet refers to lateral sides in a case in which the conveyance direction F of the prepreg sheet is assumed to be a forward direction. The distribution floating air units 5 are disposed on the lateral sides of the prepreg sheet to form a lateral side restrictor. In the present embodiment, the four distribution floating air units 5 are provided.

Figure 6:
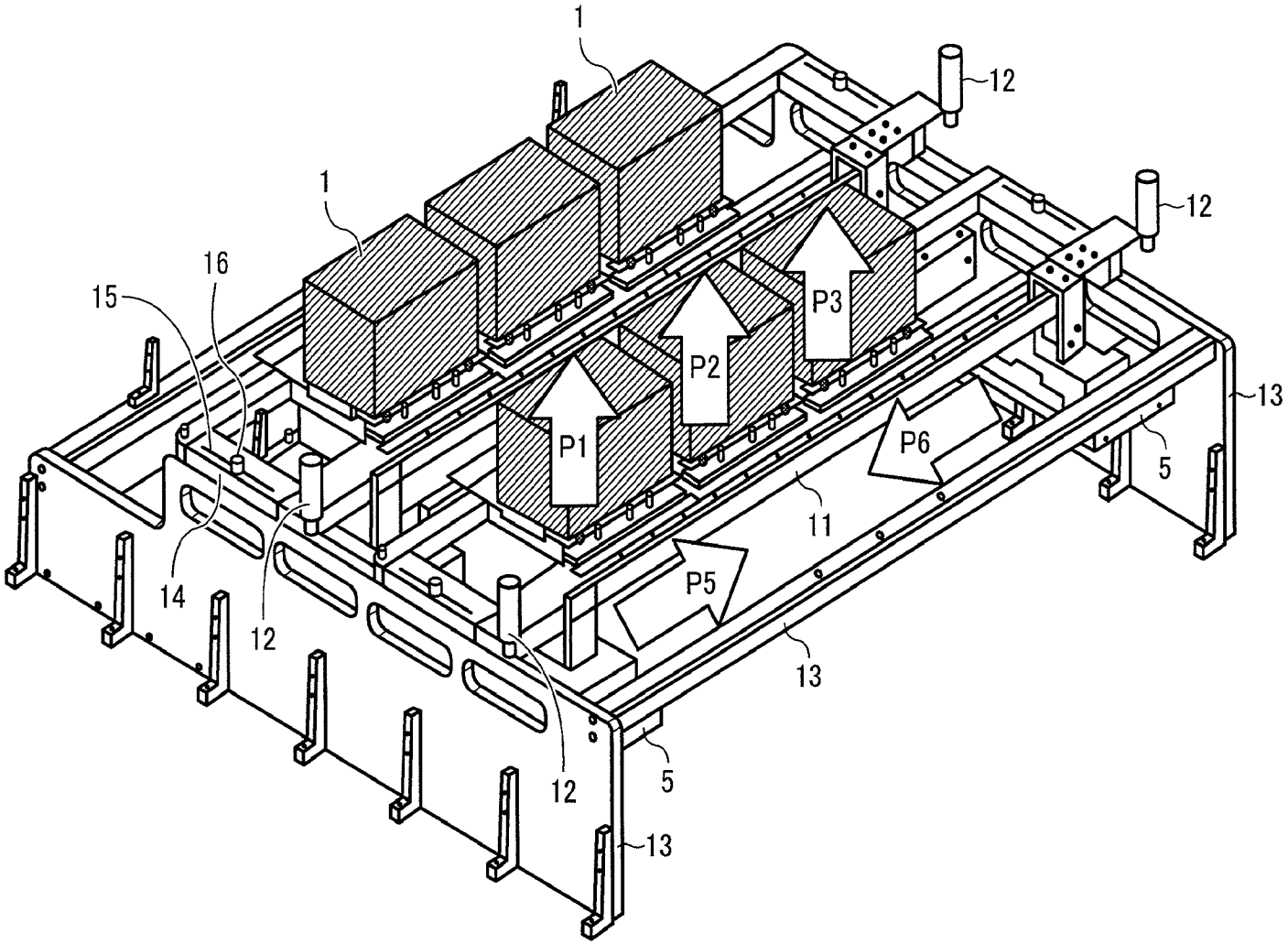
FIG. 6 is an outer perspective view of attraction air units, distribution floating air units, and a frame of the prepreg-sheet separation device.

FIG. 6 is an outer perspective view of the attraction air units 1, the distribution floating air units 5, and a frame 13 of the prepreg-sheet separation device. Air is blown out from the attraction air units 1 in directions indicated by arrows P1 to P3, and the air is blown out from the distribution floating air units 5 in directions indicated by arrows P5 and P6.

Figure 7A:
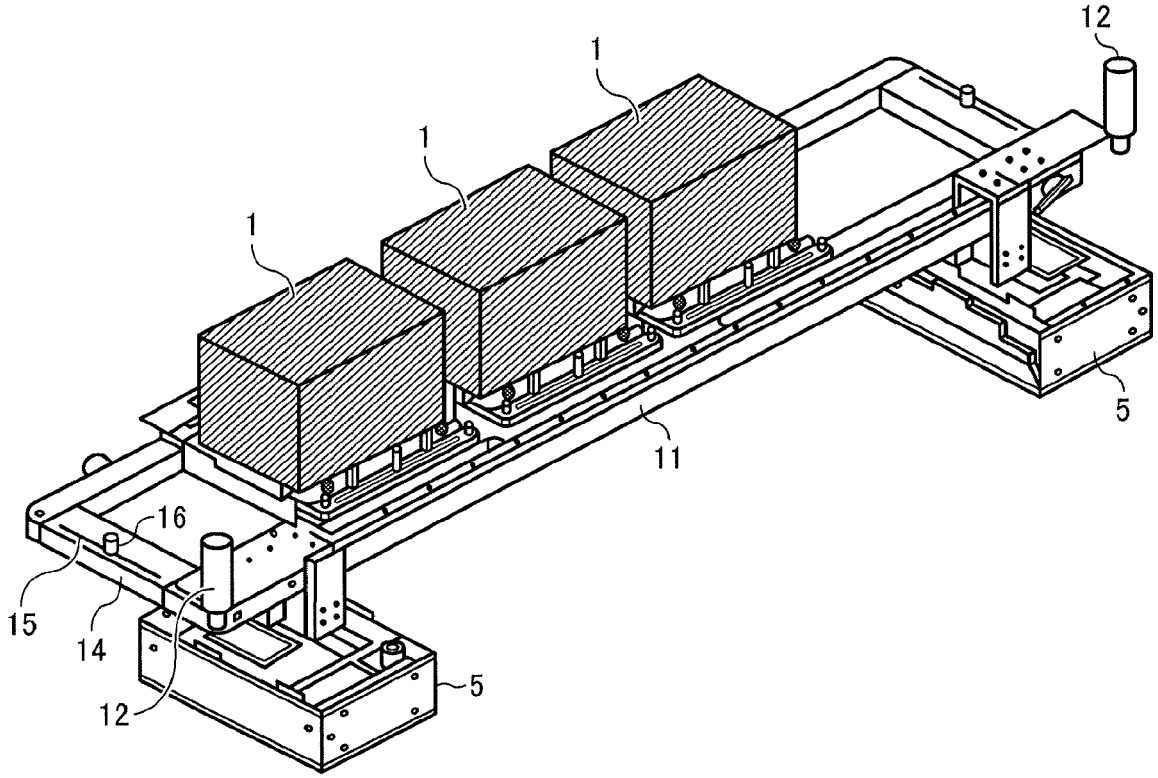
FIG. 7A is an outer perspective view of the attraction air units, the distribution floating air units, and a stay of the frame of the prepreg-sheet separation device illustrated in FIG. 6.
Figure 7B:
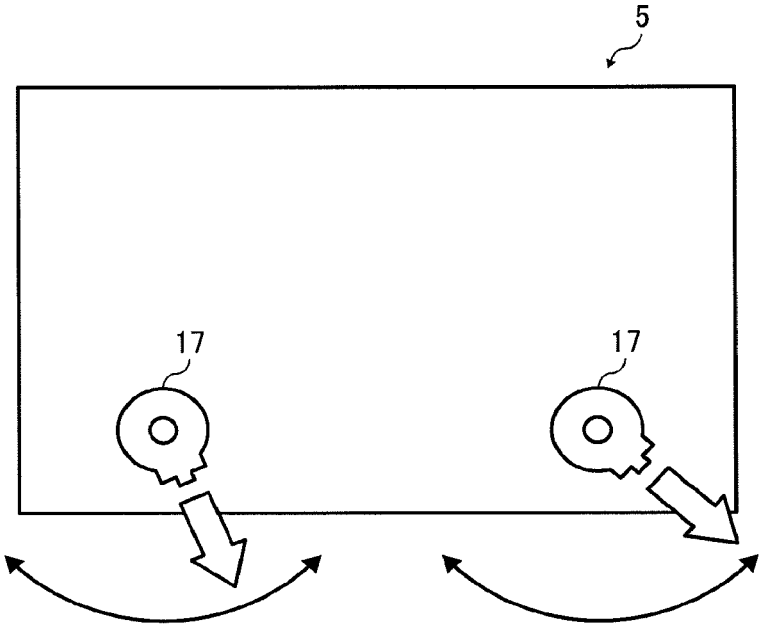
FIG. 7B is an illustration of louvers disposed in the attraction air unit illustrated in FIG. 7A.

FIG. 7A is an outer perspective view of the attraction air units 1, the distribution floating air units 5, and a stay 11 of the frame 13 of the prepreg-sheet separation device 100 illustrated in FIG. 6. FIG. 7B is an explanatory diagram of louvers 17 provided in the attraction air unit 1 illustrated in FIG. 7A.

The attraction air units 1 and the distribution floating air units 5 are integrated by the stay 11 as a connector. In FIG. 7A, the three attraction air units 1 are illustrated. However, the number of the attraction air units 1 is not limited to three and may be any suitable number. The stay 11 is secured on a rod 14 disposed on the top side along the conveyance direction F of the prepreg sheet of the frame 13. The rod 14 includes a slit 15 extending in a longitudinal direction of the rod 14. A screw 16 penetrates through the slit 15, and the leading end of the body of the screw 16 is inserted into a screw hole of the frame 13 (see FIG. 6). A handle 12 is a member to move the sheet lateral side restrictor (side fence) in a direction perpendicular to the conveyance direction F of the prepreg sheet. The handle 12 may not be provided.

The stay 11, the rod 14, and the screw 16 form an adjuster. In addition, the rod 14, the slit 15, and the screw 16 form a retainer. In other words, the attraction air units 1 and the plurality of distribution floating air units 5 are simultaneously movable in the conveyance direction F of the prepreg sheet by a user holding and moving the stay 11 or the rod 14 in the conveyance direction F of the prepreg sheet. In addition, by changing the orientation of the louvers 17, the blowing direction of air can be changed, so that fine adjustment of distribution float air is enabled.

Hardware Configuration

Figure 8:
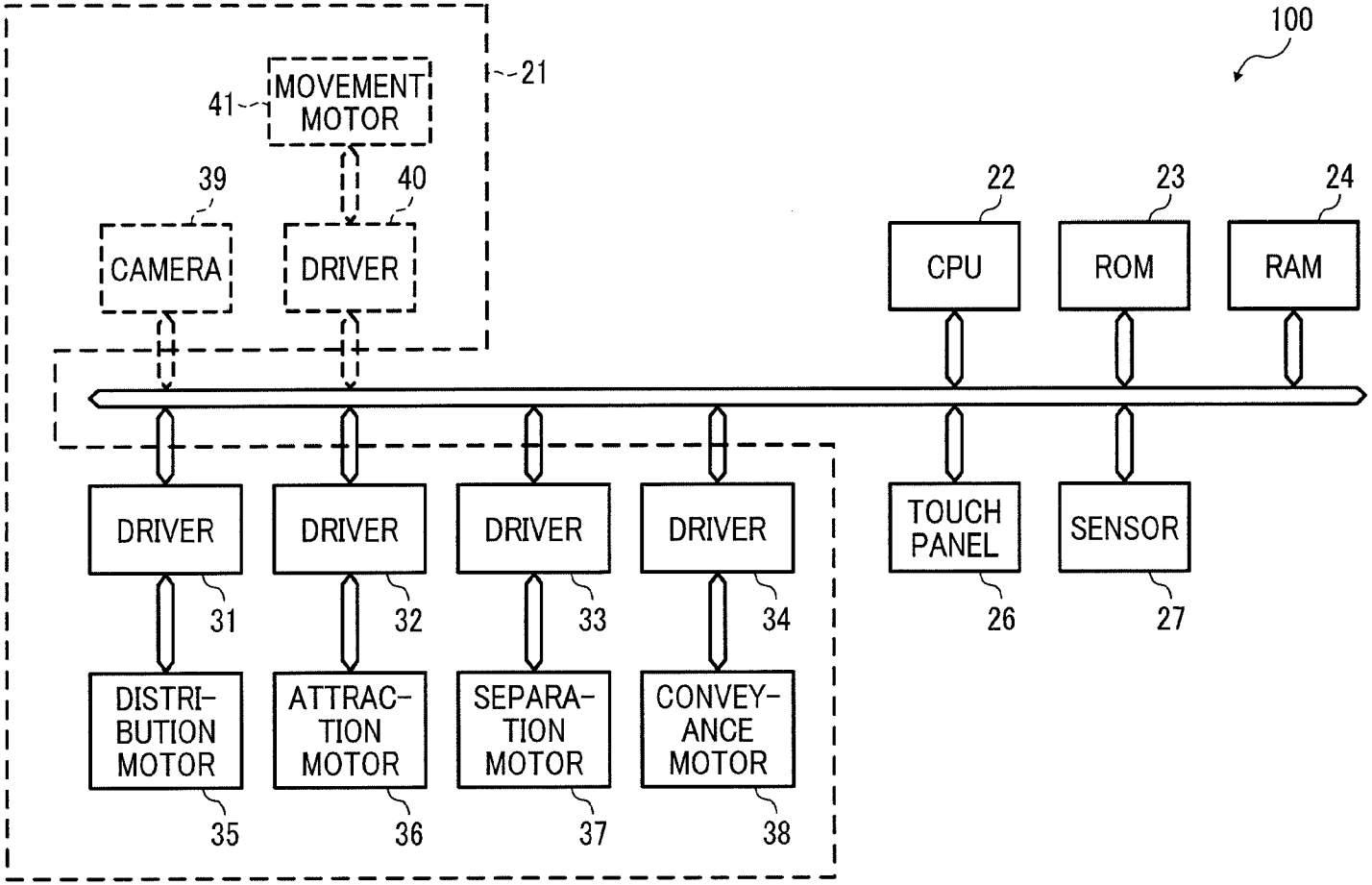
FIG. 8 is a hardware block diagram of the prepreg-sheet separation device according to an embodiment of the present disclosure.

FIG. 8 is a hardware block diagram of a prepreg-sheet separation device 100 according to an embodiment of the present disclosure. The prepreg-sheet separation device 100 includes the device body 21 of the prepreg-sheet separation device, a central processing unit (CPU) 22, a read only memory (ROM) 23, a random access memory (RAM) 24, a touch panel 26, a sensor 27, and a bus line 30.

The device body 21 of the prepreg-sheet separation device 100 can move the stay 11 or the rod 14 together with drivers 31 to 34, a distribution motor 35, an attraction motor 36, a separation motor 37, and a conveyance motor 38, when the user adjusts the positions of the attraction air units 1 and the distribution floating air units 5 while visually checking the positions.

However, when the attraction air units 1 and the distribution floating air units 5 are automatically moved by a mover, the prepreg-sheet separation device 100 further includes a camera 39, a driver 40, and a movement motor 41 in addition to the above-described configurations. In such a configuration, the mover includes the movement motor 41, a feed screw, and a ball screw. The movement motor 41 is disposed on a housing or the frame 13 as described later. The feed screw is connected to an output shaft of the movement motor 41 and disposed in parallel with the conveyance direction F. The ball screw is connected to the stay 11 as the connector and disposed on the feed screw.

The CPU is an abbreviation of a central processing unit. The CPU 22 is an element to generally control the prepreg-sheet separation device 100 and is a subject of a control program.

The ROM is an abbreviation of a read only memory. The ROM 23 is an element to store a control program. For example, a mask ROM is used.

The RAM is an abbreviation of a random access memory. The RAM 24 is an element to load the control program read from the ROM 23. For example, a flash memory is used.

The touch panel 26 is a device to display, e.g., a power switch, a start switch, a numerical keypad, a message, alarm, an abnormal location that are used for a user to operate the prepreg-sheet separation device 100.

The sensor 27 is a set of sensors to detect, e.g., temperature, humidity, the number of prepreg sheets, and abnormality.

The driver 31 is a drive circuit of the distribution motor 35 to rotate a fan blowing out distribution air. The driver 32 is a drive circuit of the attraction motor 36 to rotate a fan of the attraction air unit 1. The driver 33 is a drive circuit of the separation motor 37 to rotate a fan of the separation floating air unit 3. The driver 34 is a drive circuit of the conveyance motor 38 to drive the drive pulleys 9*a*, 9*b*, and 9*c* for the attraction belts that are illustrated in FIG. 3, to rotate. The above-described members are used when a separation state of a stack of prepreg sheets that is separated by distribution air is visually checked.

The camera 39 is a device to monitor the separation state of a stack of prepreg sheets that is separated by distribution air, not visually, but on the device side. For example, a charge coupled device (CCD) camera is used.

Figure 9A:
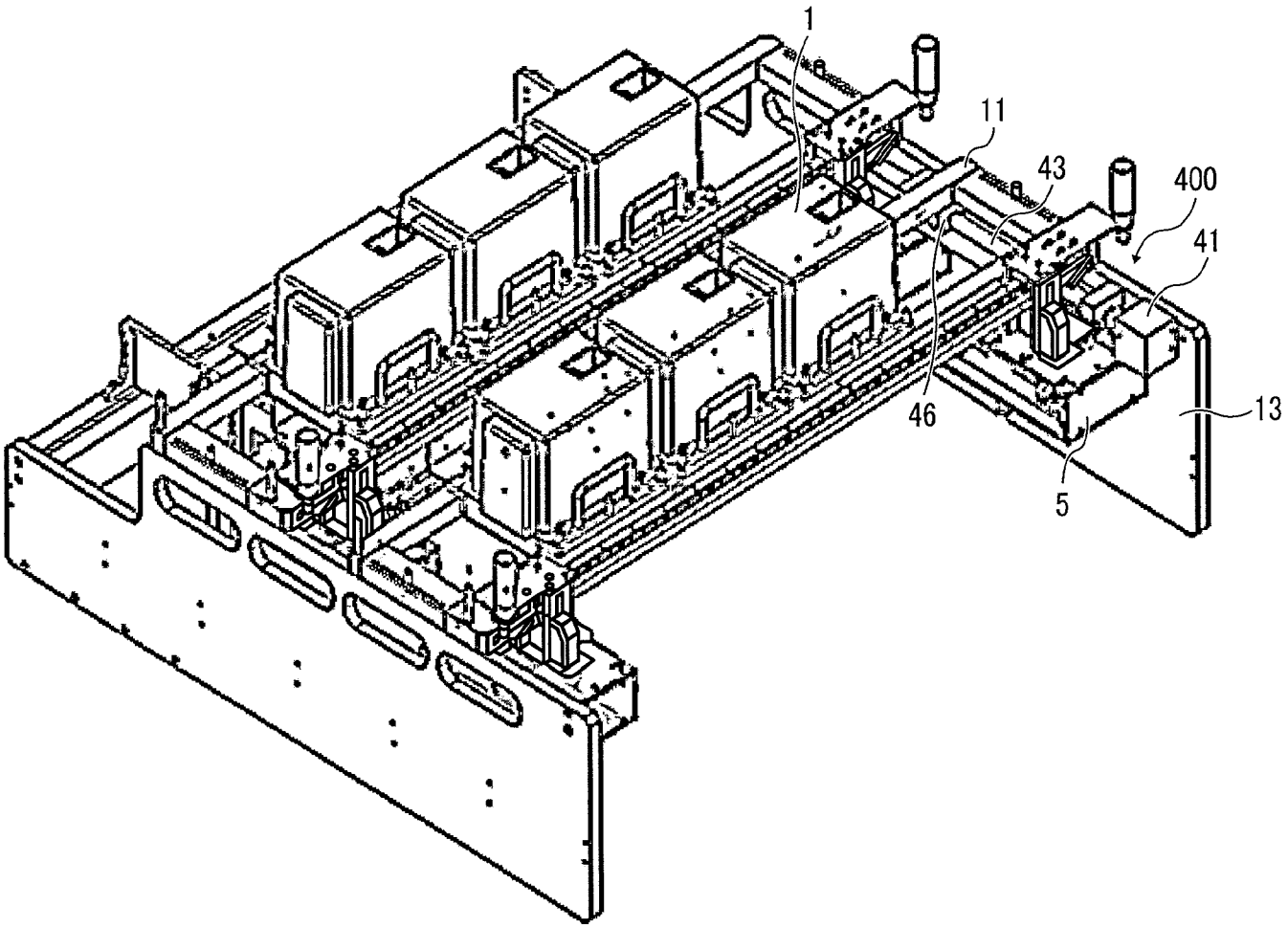
FIG. 9A is an outer perspective view of attraction air units, distribution floating air units, and a mover of the prepreg-sheet separation device.
Figure 9B:
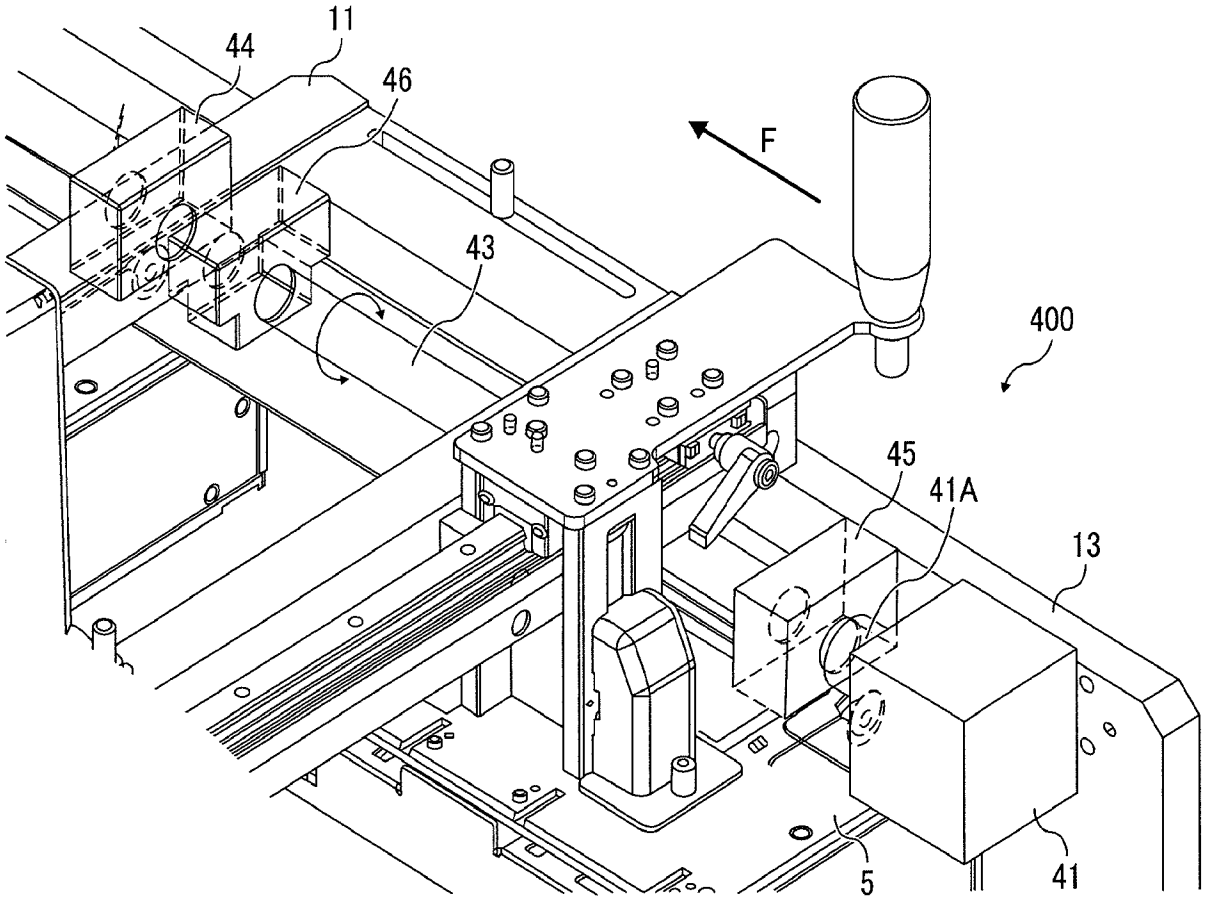
FIG. 9B is an enlarged view of the mover illustrated in FIG. 9B.

The driver 40 is a drive circuit of the movement motor 41 to simultaneously move the attraction air units 1 and the distribution floating air units 5. Here, as an example of a unit to move the attraction air units 1 and the distribution floating air units 5 not manually but automatically using the movement motor 41, as illustrated in FIG. 9A, a mover 400 includes, for example, a motor 41 on a housing or the frame 13, a feed screw 43 connected to an output shaft 41A of the motor 41 and disposed in parallel with the conveyance direction F, and a ball screw 46 connected to the stay 11 as the connector and disposed on the feed screw 43. More specifically, as illustrated in FIG. 9B, for example, the stay 11 as the connector attached with the attraction air units 1 and the distribution floating air units 5 is disposed on the frame 13 to be movable in the conveyance direction F. The feed screw 43 is rotatably held with screw supports 44 and 45. One end of the feed screw 43 is connected to the motor 41. The ball screw 46 is mounted on a shaft of the feed screw 43 and secured to the stay 11. When the positions of the attraction air units 1 and the distribution floating air units 5 are adjusted in the conveyance direction F, the motor 41 is activated to rotate the feed screw 43. Accordingly, the ball screw 46 and the stay 11 are moved along the conveyance direction F, thus allowing the positional adjustment of the attraction air units 1 and the distribution floating air units 5.

Functional Block Configuration

Figure 10:
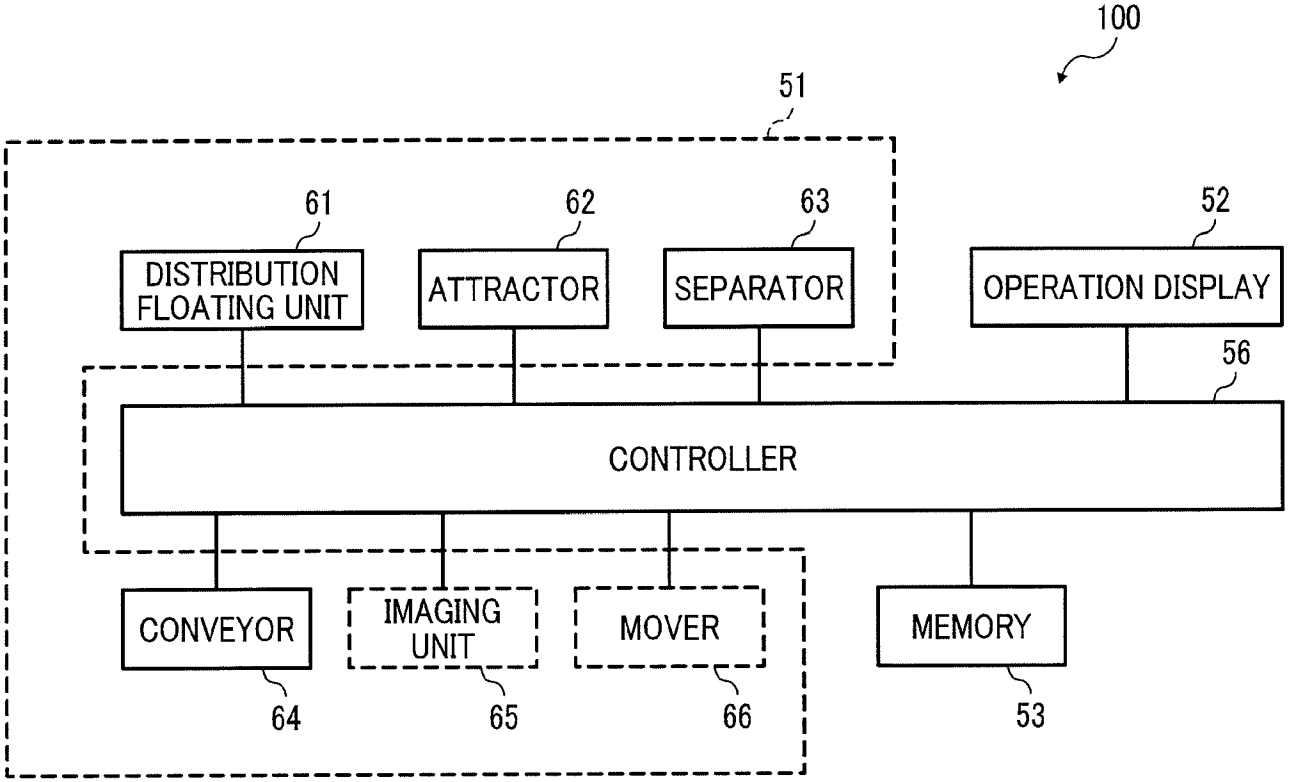
FIG. 10 is a functional block diagram of the prepreg-sheet separation device according to an embodiment of the present disclosure.

FIG. 10 is a functional block diagram of the prepreg-sheet separation device according to an embodiment of the present disclosure. The prepreg-sheet separation device 100 illustrated in FIG. 10 includes a prepreg sheet separator 51, an operation display 52, a memory 53, and a controller 56. The prepreg sheet separator 51 includes a distribution floating unit 61, an attractor 62, a separator 63, and a conveyor 64 in a configuration in which the positions of the distribution floating unit 61 and the attractor 62 are visually adjusted. However, when the positions of the distribution floating unit 61 and the attractor 62 are adjusted not visually but automatically, the prepreg sheet separator 51 further includes, e.g., an imaging unit 65 and a mover 66, which are indicated by broken lines, in addition to the above-described configuration.

The distribution floating unit 61 is implemented by the driver 31 and the distribution motor 35 illustrated in FIG. 8. The attractor 62 is implemented by the driver 32 and the attraction motor 36 illustrated in FIG. 8. The separator 63 is implemented by the driver 33 and the separation motor 37 illustrated in FIG. 8. The conveyor 64 is implemented by the driver 34 and the conveyance motor 38 illustrated in FIG. 8.

The imaging unit 65 is implemented by the camera 39 illustrated in FIG. 8. The mover 66 is implemented by the driver 40 and the movement motor 41 illustrated in FIG. 8.

The operation display 52 is implemented by the touch panel 26 illustrated in FIG. 8. The memory 53 is implemented by the ROM 23 and the RAM 24 illustrated in FIG. 8. The controller 56 is implemented by the CPU 22, the ROM 23, and the RAM 24 illustrated in FIG. 8.

Operation 1

A description is given of a case in which a user adjusts the positions of the attraction air units 1 and the distribution floating air units 5 while visually checking the positions. The user views the state of the uppermost prepreg sheet of the stack of prepreg sheets that is caused by air blown out from the distribution floating air unit 5 of the prepreg-sheet separation device 100. In other words, the user visually checks a separation state or a deflected state of the stack of prepreg sheets. If the separation state is abnormal, the positions of the attraction air units 1 and the distribution floating air units 5 are adjusted by moving the stay 11 or the rod 14 (FIG. 6).

Operation 2

Figure 11:
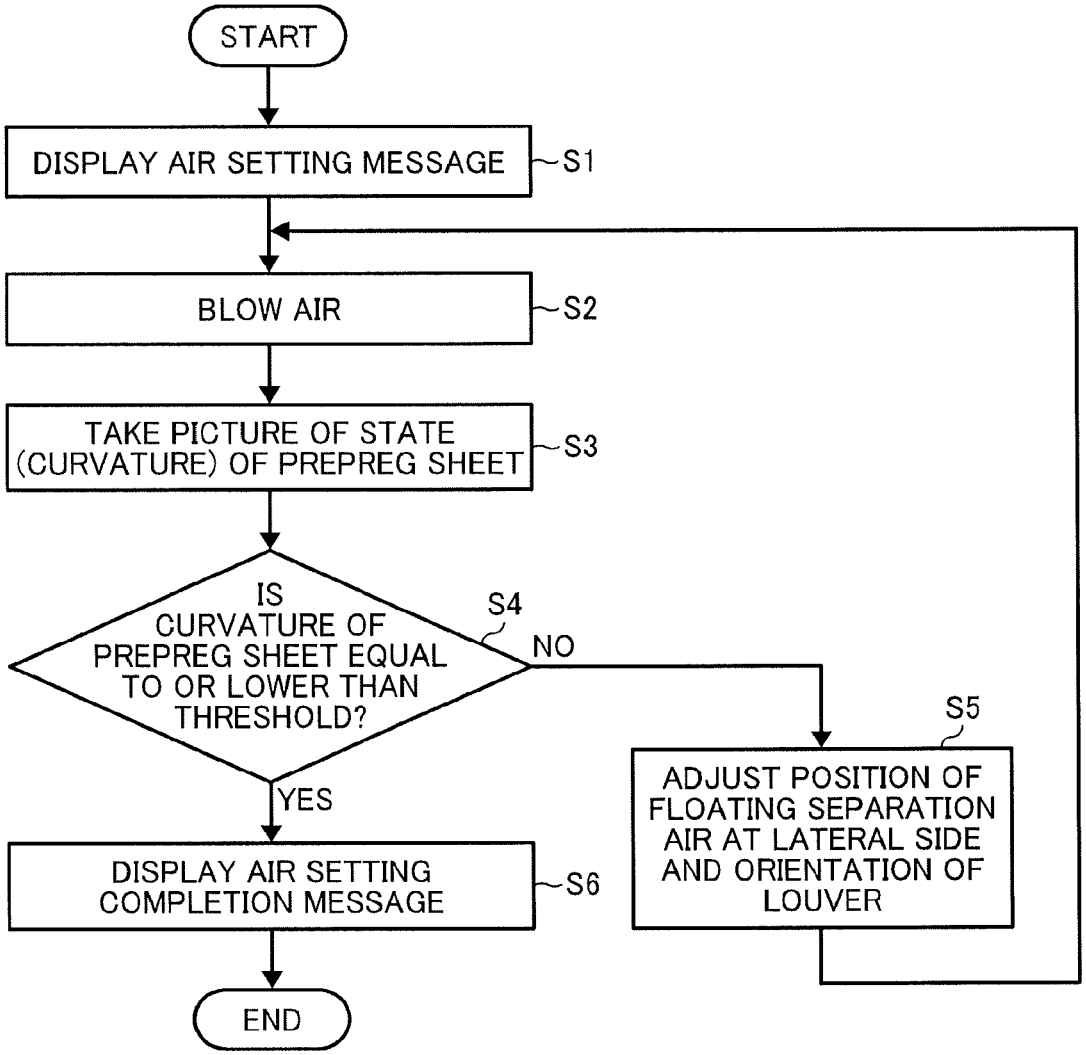
FIG. 11 is a flowchart of an operation flow of the prepreg-sheet separation device according to an embodiment of the present disclosure.

A description is given of a case in which the positions of the attraction air units 1 and the distribution floating air units 5 are automatically adjusted. FIG. 11 is a flowchart of an example of an operation flow of the prepreg-sheet separation device 100. A message for performing air setting is displayed on the touch panel 26 (step S1), and air is blown using a default setting air condition (step S2). A state (curvature) of the prepreg sheet onto which air has been blown is shot by the camera 39 (step S3). The controller 56 checks whether the curvature of the prepreg sheet is equal to or smaller than a prescribed value (step S4). If the curvature of the prepreg sheet is not equal to or smaller than the prescribed value (step S4/NO), a floating separation air position on the side and the louvers are adjusted (step S5), and the process returns to the air blowing operation (step S2). If the curvature of the prepreg sheet is equal to or smaller than the prescribed value (step S4/YES), air setting is completed, and a message indicating an air setting completion is displayed on the touch panel 26 (step S6).

As described above, by integrating and interlocking the distribution floating unit and the attractor, position adjustment can be performed according to the prepreg sheet in a state in which the correlation of distribution and attract is maintained. As a result, in the prepreg-sheet separation device, a unit of a distribution air blowing port and the attractor is formed to be integrally movable in the sheet conveyance direction in conjunction with each other. The separation performance is accordingly enhanced by disposing the unit at a position suitable for a sheet length and sheet rigidity (resilience).

Program

The above-described prepreg-sheet separation device according to the present disclosure is implemented with a program that causes processing to be executed in a computer. Below, a description is given of an example case in which the function of the present disclosure is implemented with the program.

For example, the program implemented in the prepreg-sheet separation device is a program that can be read by a computer of the prepreg-sheet separation device and causes the computer to execute a procedure for causing the distribution floating unit to float a prepreg sheet by blowing air onto an upper part of a stack of prepreg sheets, a procedure for causing the attractor to attract the floated uppermost prepreg sheet of the stack, a procedure for causing the separator to separate the floated uppermost prepreg sheet and a prepreg sheet stacked immediately below the uppermost prepreg sheet, a procedure for causing the conveyor to suck and convey the floated uppermost prepreg sheet, and a procedure for causing the mover to move the distribution floating unit and the attractor together in the conveyance direction of the prepreg sheet.

Such a program may be stored in a computer readable storage medium.

Storage Medium

Here, examples of the storage medium include a computer readable storage medium, such as a compact disk read only memory (CD-ROM), a flexible disk (FD), and a compact disk recordable (CD-R), a semiconductor memory such as a flash memory, a RAM, a ROM, and a ferroelectric random access memory (FeRAM), and a hard disk drive (HDD).

The CD-ROM is an abbreviation of a compact disc read only memory. The flexible disk means a flexible disk: FD. The CD-R is an abbreviation of a CD recordable. The FeRAM is an abbreviation of a ferroelectric RAM, and means a ferroelectric memory.

Second Embodiment: Image Forming Apparatus

Figure 12:
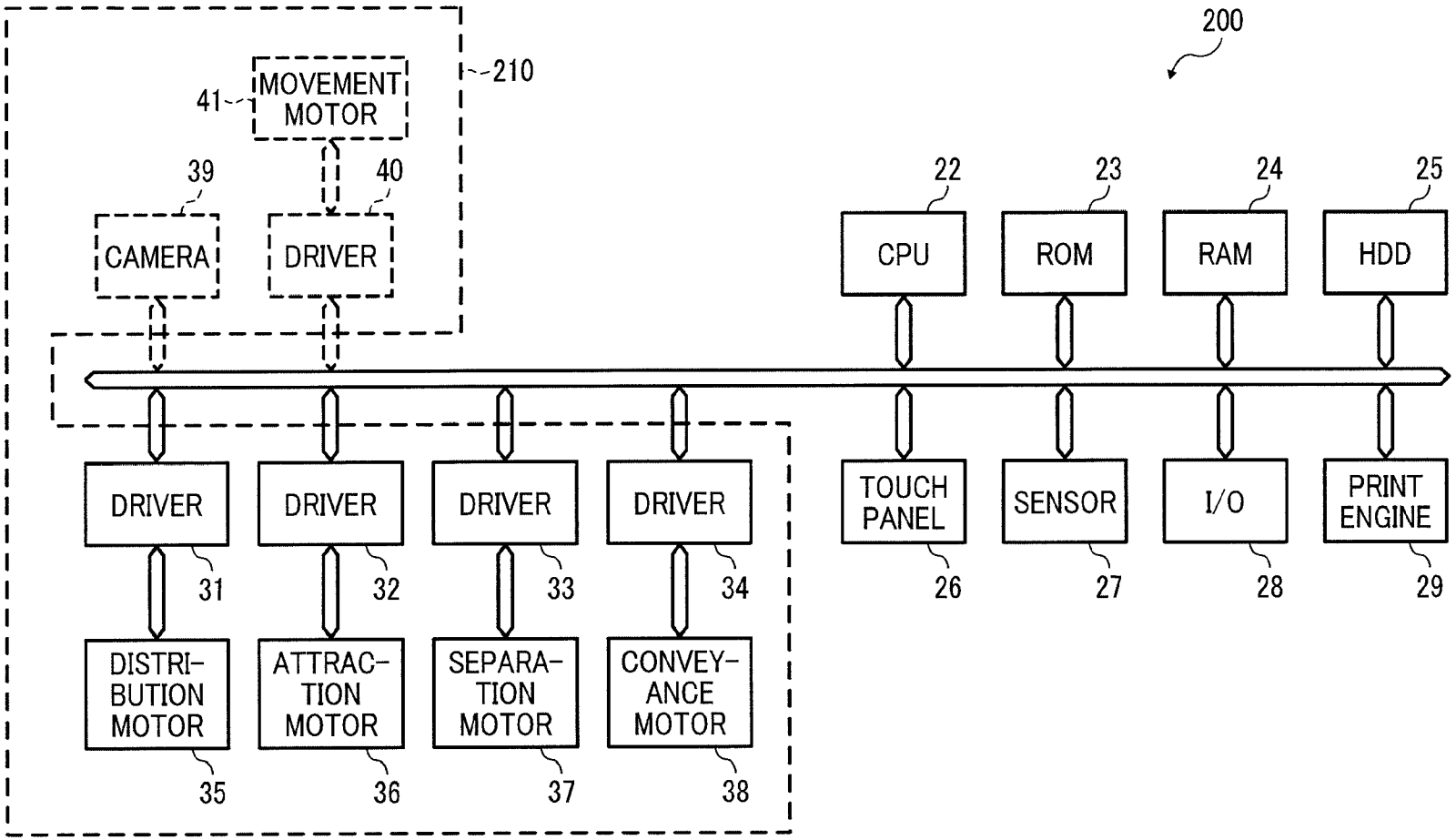
FIG. 12 is a hardware block diagram of an image forming apparatus including a sheet-member separation device according to an embodiment of the present disclosure.

Next, an image forming apparatus according to an embodiment of the present disclosure is described below. Hardware Configuration FIG. 12 is a hardware block diagram of an image forming apparatus according to an embodiment of the present disclosure. Redundant descriptions of members similar to the members in the prepreg-sheet separation device 100 according to the above-described embodiment are omitted below.

An image forming apparatus 200 according to an embodiment of the present disclosure includes a sheet-member separation device 210, a CPU 22, a ROM 23, a RAM 24, an HDD 25, a touch panel 26, a sensor 27, an input/output (I/O) 28, a print engine 29, and a bus line 30.

The CPU 22 is an element to generally control the image forming apparatus 200 and is a subject of a control program.

The HDD 25 is an abbreviation of a hard disk drive. The HDD 25 is a device to store, e.g., image data and document data to be printed. In some embodiments, a solid state drive (SSD) may be used in place of the HDD 25.

The touch panel 26 is a device to display, e.g., a power switch, a start switch, a numerical keypad, a message, alarm, and an abnormal location that are used for the user to operate the image forming apparatus 200.

The I/O 28 is an abbreviation of an input/output and is a device to input an image or document data from an external device such as, for example, a personal computer, and respond to the external device.

The print engine 29 is a device to print image data and document data. Examples of a sheet member, which is separated by the sheet-member separation device 210, and on which an image is formed, include a sheet of paper and an overhead projector (OHP) sheet.

Functional Block Configuration

Figure 13:
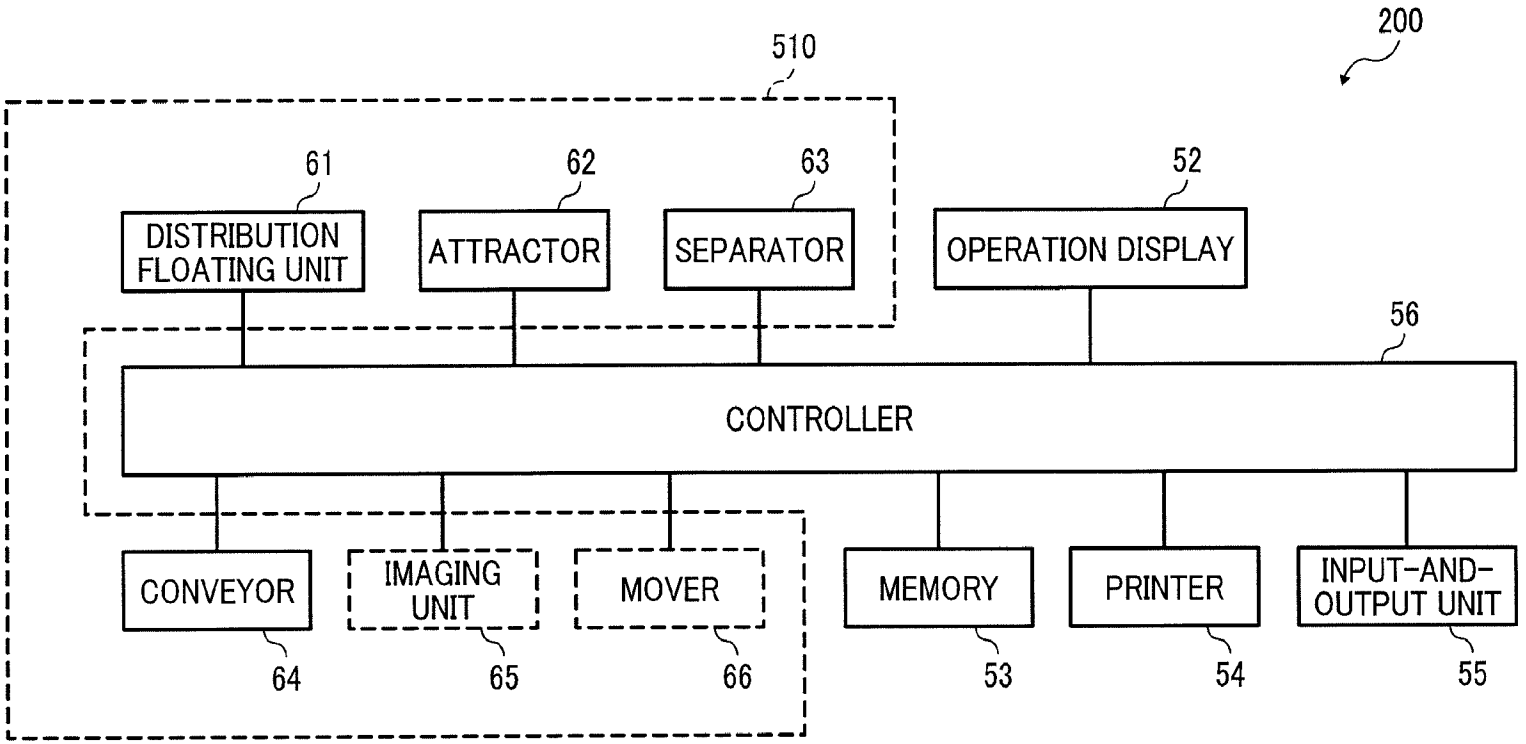
FIG. 13 is a functional block diagram of the image forming apparatus including the sheet-member separation device according to an embodiment of the present disclosure.

FIG. 13 is a functional block diagram of the image forming apparatus according to an embodiment of the present disclosure. The image forming apparatus 200 illustrated in FIG. 13 includes a sheet-member separator 510, an operation display 52, a memory 53, a printing unit 54, an input-and-output unit 55, and a controller 56.

The operation display 52 is implemented by the touch panel 26 illustrated in FIG. 12. The memory 53 is implemented by the ROM 23, the RAM 24, and the HDD 25 illustrated in FIG. 12. The printing unit 54 is implemented by the print engine 29 illustrated in FIG. 12. The input-and-output unit 55 is implemented by the I/O 28 illustrated in FIG. 12. The controller 56 is implemented by the CPU 22, the ROM 23, and the RAM 24 illustrated in FIG. 12.

An operation of the sheet-member separation device 210 in the image forming apparatus 200 is similar to the operation of the prepreg-sheet separation device 100 illustrated in FIG. 8. A separated sheet member is subjected to printing by the print engine 29.

As described above, according to at least one embodiment of the present disclosure, sheet members can be accurately separated from each other.

The above-described embodiments are example embodiments. The embodiments of the present disclosure are not limited to the above-described embodiments, and various types of variations can be made without departing from the gist of the present disclosure.

For example, in the above-described first embodiment, a prepreg sheet is described as an example of the sheet member. However, the sheet member may be a sheet member, such as a sheet of paper (the second embodiment) and beaten copper. In addition, for example, in the above-described embodiments, the example in which the size of the sheet member is 700 mm×500 mm is described. However, embodiments of the present disclosure are not limited to the example, and the sheet member may have a size larger than the size of 700 mm×500 mm, or a smaller size, such as the A4 size and the B5 size.

What is claimed is:

1. A sheet-member separation device comprising:

a first air blower to blow air onto a front side of a stack of sheet members in a sheet-member conveyance direction;

an attractor to attract an uppermost sheet member floated from the stack of sheet members by the air blown from the first air blower;

a conveyor to convey, in the sheet-member conveyance direction, the sheet member attracted by the attractor;

a second air blower to blow air toward a lateral side of the sheet member;

a camera to monitor a separation state of the sheet member, the separation state determined relative to a threshold value; and an adjuster to move the second air blower and the attractor together to adjust positions at which the second air blower and the attractor are located in the sheet-member conveyance direction, wherein the adjuster includes:

a connector to connect the second air blower and the attractor; and a mover to move the connector along the sheet-member conveyance direction, and wherein, when the separation state is outside a range relative to the threshold value, the positions of the second air blower and the attractor are moved by the adjuster such that the separation state of the sheet member is within the range relative to the threshold value.

2. The sheet-member separation device according to claim 1, wherein the mover includes:

a motor provided on a housing;

a feed screw connected to an output shaft of the motor and disposed in parallel with the sheet-member conveyance direction; and a ball screw connected to the connector and disposed on the feed screw.

3. An image forming apparatus comprising the sheet-member separation device according to claim 1.

4. The sheet-member separation device according to claim 1, wherein the second air blower includes a louver to change a blowing direction of air and, when the separation state is outside a range relative to the threshold value, an orientation of the louver is adjusted.

5. The sheet-member separation device according to claim 1, wherein the second air blower and the attractor are integrally moved by the adjuster.

6. The sheet-member separation device according to claim 1, wherein the separation state indicates a curvature of the sheet member.

7. A sheet-member separation method comprising:

blowing air, by a first air blower, onto a front of a stack of sheet members in a sheet-member conveyance direction;

monitoring a separation state of an uppermost sheet member floated from the stack of sheet members by the air blowing from the first air blower, the separation state determined relative to a threshold value;

attracting, by an attractor, the floated uppermost sheet member;

separating the floated uppermost sheet member from a sheet member immediately below the uppermost sheet member of the stack of sheet members;

sucking and conveying the floated uppermost sheet member; and moving the attractor and a second air blower to blow air toward a side of the sheet member, together along the sheet-member conveyance direction to adjust positions at which the attractor and the second air blower are located in the sheet-member conveyance direction, wherein the moving is conducted using:

a connector to connect the second air blower and the attractor; and a mover to move the connector along the sheet-member conveyance direction, and wherein, when the separation state is outside a range relative to the threshold value, the positions of the second air blower and the attractor are moved such that the separation state of the sheet member is within the range relative to the threshold value.

8. The sheet-member separation method according to claim 7, wherein the mover includes:

a motor provided on a housing;

a feed screw connected to an output shaft of the motor and disposed in parallel with the sheet-member conveyance direction; and a ball screw connected to the connector and disposed on the feed screw.

9. The sheet-member separation method according to claim 7, wherein the second air blower is a lateral side restrictor disposed at each lateral side of the sheet member.

10. The sheet-member separation method according to claim 7, the second air blower including a louver to change a blowing direction of air, the method further comprising adjusting an orientation of the louver when the separation state is outside a range relative to the threshold value.

11. The sheet-member separation device according to claim 7, wherein the second air blower and the attractor are integrally moved.

12. The sheet-member separation device according to claim 7, wherein the separation state indicates a curvature of the sheet member.

13. A non-transitory computer readable storage medium storing a computer readable program to cause a computer of a sheet-member separation device to execute processes of:

causing a first air blower to blow air onto a front of a stack of sheet members in a sheet-member conveyance direction;

monitoring a separation state of an uppermost sheet member floated from the stack of sheet members by the air blowing from the first air blower, the separation state determined relative to a threshold value;

causing an attractor to attract the uppermost sheet member;

causing a conveyor to convey, in the sheet-member conveyance direction, the uppermost sheet member attracted by the attractor;

causing a second air blower to blow air toward a lateral side of the uppermost sheet member; and causing an adjuster to move the second air blower and the attractor together to adjust positions at which the second air blower and the attractor are located in the sheet-member conveyance direction, wherein the adjuster includes:

a connector to connect the second air blower and the attractor; and a mover to move the connector along the sheet-member conveyance direction, wherein, when the separation state is outside a range relative to the threshold value, the positions of the second air blower and the attractor are moved by the adjuster such that the separation state of the sheet member is within the range relative to the threshold value.

14. The non-transitory computer readable storage medium according claim 13, wherein the mover includes:

a motor provided on a housing;

a feed screw connected to an output shaft of the motor and disposed in parallel with the sheet-member conveyance direction; and a ball screw connected to the connector and disposed on the feed screw.

15. The non-transitory computer readable storage medium according to claim 13, wherein the second air blower is a lateral side restrictor disposed at each lateral side of the sheet member.

16. The non-transitory computer readable storage medium according to claim 13, wherein the second air blower includes a louver to change a blowing direction of air and, when the separation state is outside a range relative to the threshold value, an orientation of the louver is adjusted.

17. The non-transitory computer readable storage medium according to claim 13, wherein the second air blower and the attractor are integrally moved by the adjuster.

18. The non-transitory computer readable storage medium according to claim 13, wherein the separation state indicates a curvature of the sheet member.

* * * * *